US005593288A

United States Patent [19]

Kikutani

[11] Patent Number: 5,593,288

[45] Date of Patent: Jan. 14, 1997

[54] LIQUEFIED GAS PUMP

[75] Inventor: Isao Kikutani, Kobe, Japan

[73] Assignee: Nabco Limited, Kobe, Japan

[21] Appl. No.: 561,813

[22] Filed: Nov. 22, 1995

[30] Foreign Application Priority Data

Nov. 25, 1994 [JP] Japan ..... 6-315830

[51] Int. Cl.[6] ..... F04B 21/00

[52] U.S. Cl. ..... 417/435; 417/460; 417/466; 417/495; 417/502

[58] Field of Search ..... 417/435, 493, 417/495, 460, 466, 502

[56] References Cited

U.S. PATENT DOCUMENTS

| | | | |
|---|---|---|---|
| 1,849,490 | 3/1932 | Junkers | 417/493 X |
| 2,050,536 | 8/1936 | Meyer | 417/466 |
| 2,118,234 | 5/1938 | Rupp | 417/435 |
| 2,524,645 | 10/1950 | Abbott | 417/460 X |
| 3,013,702 | 12/1961 | Honisek et al. | 417/460 X |
| 3,455,246 | 7/1969 | Borowiec et al. | 417/493 X |
| 4,854,835 | 8/1989 | Onishi | 417/435 |
| 5,188,519 | 2/1993 | Spulgis | 417/511 |

FOREIGN PATENT DOCUMENTS

| | | |
|---|---|---|
| 63-16587 | 4/1988 | Japan . |
| 63-138173 | 6/1988 | Japan . |

*Primary Examiner*—Richard E. Gluck

*Attorney, Agent, or Firm*—William H. Murray; Robert E. Rosenthal

[57] ABSTRACT

A liquefied gas pump includes a piston and a cylinder which form a pump chamber into which a liquefied gas entrance path and a liquefied gas discharge path open. Relative upward and downward motion between the piston and cylinder provides a repetition of alternating suction and discharge stroke. Liquefied gas is sucked into the pump chamber through the entrance path during the suction strokes, and is discharged out of the pump chamber through the discharge path during the discharge strokes. A separate bubble discharge path opens into said pump chamber at a location in the bottom of an upward recess formed in the top portion of the pump chamber. The bottom of the recess is located above the location where the opening of the liquefied gas discharge path is formed.

3 Claims, 6 Drawing Sheets

LIQUEFIED GAS PUMP

The present invention relates to a liquefied gas pump for transferring liquefied gas from, for example, a liquefied gas tank to a desired location.

BACKGROUND OF THE INVENTION

Like pumps for general use, a liquefied gas pump also includes a pump chamber. The pump chamber is formed by a cylinder and a piston, and liquefied gas entrance and discharge ports open into it. The pump chamber is formed by a cylinder and a piston. Relative motion between the piston and the cylinder provides repetition of alternate suction and discharge of liquefied gas through the entrance port into the pump chamber and through the discharge port out of the pump chamber, respectively.

Due to reduction in pressure in the pump chamber during the suction stroke or due to cavitation caused by friction heat generated at surfaces of the piston and the cylinder which slide relative to each other, bubbles of the gas may be generated in the liquefied gas. Such bubbles return to liquid when the pressure of the liquefied gas during the discharge stroke exceeds the saturated vapor pressure of the gas. When the bubbles return to liquid, strong shocks and vibrations could be generated and, at the same time, the metal surfaces of the piston and the cylinder could be eroded.

A pump which can transfer such bubbles out of a pump chamber is shown in, for example, U.S. Pat. No. 5,188,519. In the pump of this patent, bubbles are driven out through the liquefied gas entrance port during suction strokes.

In this pump, the entrance port functions also as a bubble discharge port. It is considered that since bubbles must be discharged through the liquefied gas entrance port against the flow of the liquefied gas, the amount of bubbles which can be discharged out of the pump chamber is relatively small. In particular, since liquefied gas has high viscosity, the fluidity of bubbles is low so that all of them cannot be efficiently discharged.

An object of the present invention is to provide a liquefied gas pump which can drive out bubbles generated in a pump chamber due to cavitation.

SUMMARY OF THE INVENTION

A liquefied gas pump according to the present invention includes a piston and a cylinder which form a pump chamber having a liquefied gas entrance port and a liquefied gas discharge port. Relative motion of the piston with respect to the cylinder provides repetition of alternation of suction and discharge of liquefied gas through the entrance port and the discharge port into and out of the pump chamber. The pump is provided with a separate bubble discharge port which enables the upper portion of the pump chamber to communicate with the exterior during a beginning part of the discharge stroke.

According to one aspect of the invention, an upward extending recess is formed in the wall of the cylinder in the upper end portion of the pump chamber such that the topmost portion or bottom of the recess is located above the liquefied gas discharge port of the pump. The bubble discharge port is formed in the topmost portion of the recess and is connected to one end of a bubble discharge path of which the other end opens into the exterior of the pump chamber.

According to another aspect of the invention, the upper end portion of the pump chamber is provided by one end of the piston. The piston is fixed to the lower end of a pipe of which the upper end is fixed. A rod extends through the pipe, and the cylinder is fixed to the lower end of the rod. Reciprocal drive means is coupled to the upper end of the rod. The reciprocal drive means drives the cylinder to reciprocate up and down. The reciprocal drive means may be provided with means for providing downward driving force to the cylinder when the cylinder moves downward.

According to still another aspect of the invention, one end portion of the cylinder provides the upper end portion of the pump chamber. The cylinder is fixed to the lower end of a pipe of which the upper end is to be fixed. A rod extends through the pipe. The lower end of the rod extends into the cylinder through the one end portion of the cylinder. The piston is coupled to the lower end of the rod. Reciprocal drive means is coupled to the upper end of the rod. The reciprocal drive means drives the piston to reciprocate up and down. The reciprocal drive means may be provided with means for providing downward driving force to the piston when the piston moves downward.

According to a further aspect of the present invention, bubble discharge port opening and closing means is provided. The bubble discharge port opening and closing means opens the bubble discharge port in at least the beginning portion of the discharge stroke, and thereafter, closes the bubble discharge port and maintains it closed until the end of the discharge stroke.

In a pump with the piston fixed and with the cylinder reciprocating, the bubble discharge port is formed in the piston. The bubble discharge port opening and closing means may be provided by forming a window in the cylinder which extends upward from a point in the middle portion of the cylinder. When the cylinder starts upward motion from the bottom dead center, the bubble discharge port is in communication with the exterior of the pump chamber through the window in the cylinder, and when the cylinder moves further upward, the bubble discharge port is closed by the portion of the cylinder below the window.

For a pump with the cylinder fixed and with the piston reciprocating, the bubble discharge port is formed in the cylinder. The bubble discharge port opening and closing means may be provided by valve ports formed in the pump chamber side and exterior side of the bubble discharge path to which the bubble discharge port connects, and a valve body disposed in the bubble discharge path which closes the pump chamber side valve port when the pressure in the pump chamber is lower than the exterior pressure, and closes the exterior side valve port when the pump chamber pressure is higher than the exterior pressure.

DESCRIPTION OF PREFERRED EMBODIMENTS OF THE INVENTION

Figure 1:
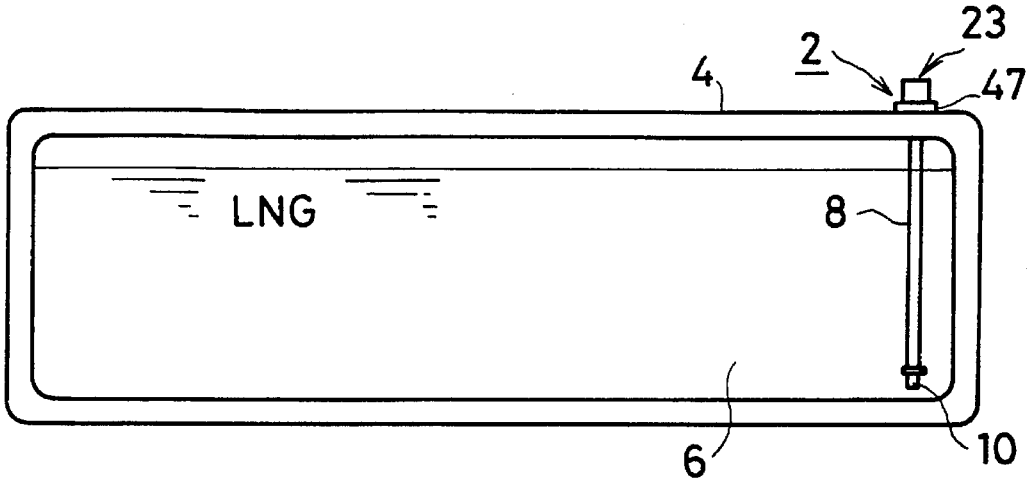
FIG. 1 illustrates how a liquefied gas pump according to a first embodiment of the present invention is used.

Now, a liquefied gas pump according to a first embodiment of the present invention is described with reference to FIGS. 1 through 4*d*. As shown in FIG. 1, the liquefied gas pump 2 according to the first embodiment is used to transfer liquefied gas 6 from a fuel tank 4 to a desired location, such as a vaporizer of an internal combustion engine (not shown), for example. The pump 2 is disposed in a pipe 8 and a protective cover 10. The pipe extends from the top surface of the tank 4 to a point near the bottom of the tank 4, and the protective cover 10 is attached to the bottom end of the pipe 8.

Figure 2:
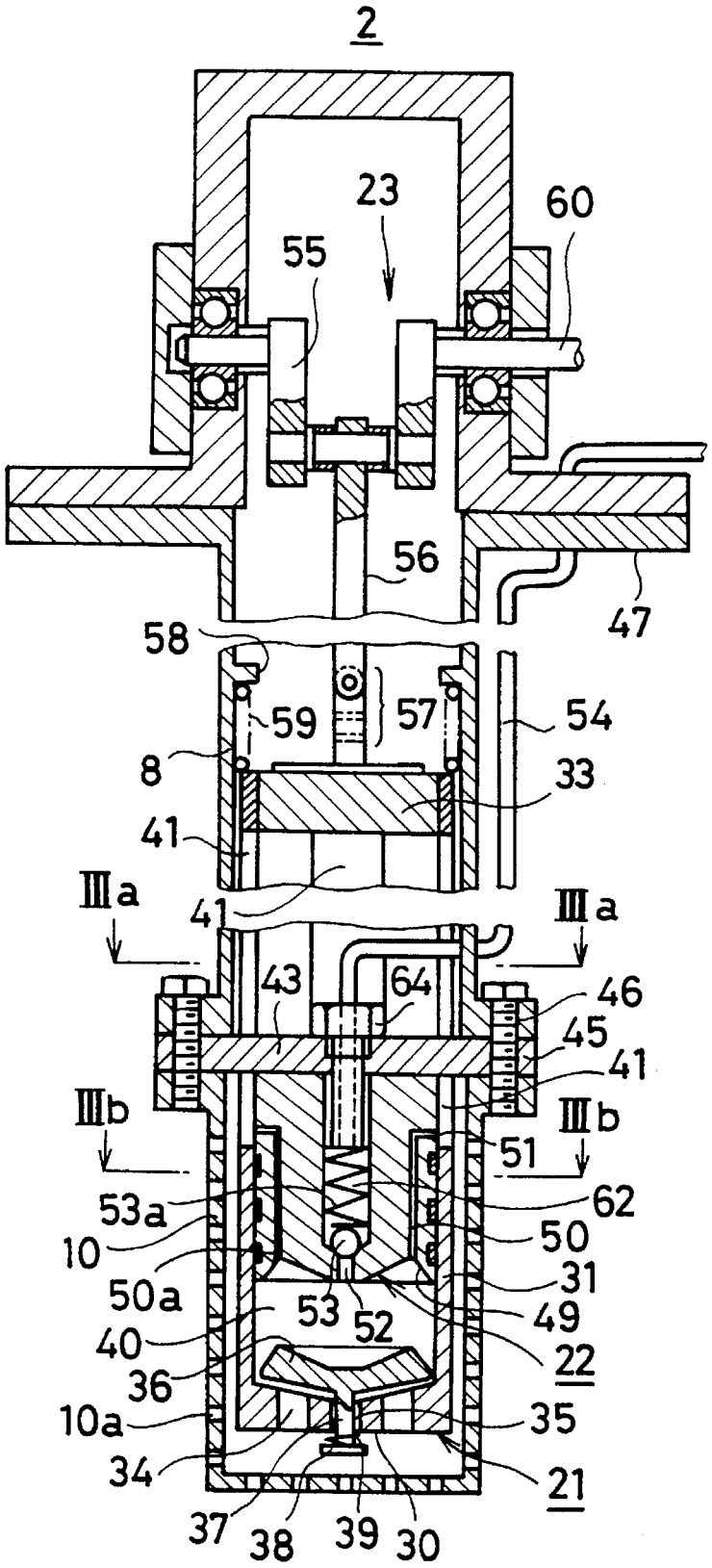
FIG. 2 is a longitudinal cross-sectional view of the liquefied gas pump according to the first embodiment with portions thereof not shown.

As shown in FIG. 2, a cylinder 21 is disposed within the pipe 8 and the protective cover 21. A piston 22 is fitted into the cylinder 21. In the illustrated pump 2, the piston 22 is fixed, and the cylinder 21 is driven to reciprocate up and down. The reciprocating motion of the cylinder 21 is provided by a reciprocal drive arrangement 23 fixed to a flange 47 at the upper end portion of the pipe 8.

The cylinder 21 has an open upper end which is closed by a disc-shaped end plate 33 fixed to the cylinder 21. As will be described later, the reciprocal drive arrangement 23 is coupled to the end plate 33.

The cylinder 21 has at its lower end a circular bottom wall 30 formed integral with the cylinder 21. The upper surface of the bottom wall 30 is tapered downward toward the center of the wall 30. Liquefied entrance ports or entrance valve ports 34 are formed in the bottom wall 30 at equal angular intervals. In the illustrated example, four entrance valve ports 34 are formed at angular intervals of 90 degrees. A valve supporting hole 35 extends vertically through the center of the wall 30. An entrance valve 36 for opening and closing the respective entrance valve ports 34 rests on the upper surface of the cylinder bottom wall 30 with its downward extending stem 37 extending through the hole 35 in such a manner as to permit longitudinal movement of the stem 37 and, hence, the valve 36 in the hole 35.

The entrance valve 36 has a conical bottom surface which is complementary to the shape of the upper surface of the bottom wall 30. The upper surface of the entrance valve 36 has a shape complementary to the shape of the bottom surface of the piston 22. A retaining member 38 for preventing the valve 36 from being removed is provided at the lower end of the stem 37. A coil spring 39 is compressed between the valve retaining member 38 and the bottom surface of the bottom wall 30 so that the entrance valve 36 is normally pulled downward to thereby close the entrance ports 34. When the pressure within a pump chamber 40 defined by the side wall of the cylinder 21, the bottom wall 30, and the piston 22 becomes lower than the pressure in the exterior of the pump 2 by a predetermined amount, the entrance valve 36 moves upward against the coil spring 39 to thereby open the entrance ports 34.

A plurality of windows 41 are formed in the side wall of the cylinder 21 to extend upward from a point in the intermediate portion of the cylinder 21 to the upper end of the cylinder 21 along the length of the cylinder. The windows are spaced at equal angular intervals along the periphery of the cylinder 21. In the illustrated example, four windows 41 are provided, being spaced by 90 degrees from each other.

Figure 3A:
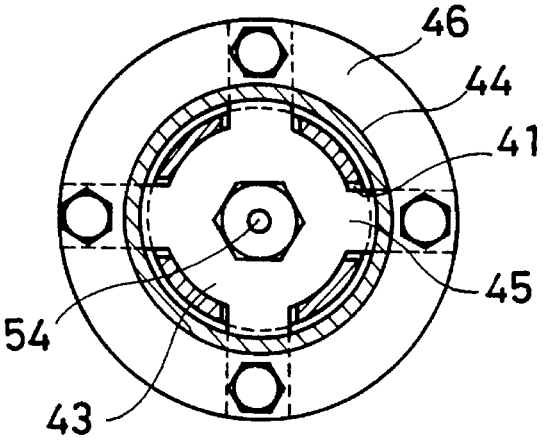
FIG. 3*a* is a cross-sectional view along IIIa—IIIa in FIG. 2.
Figure 3B:
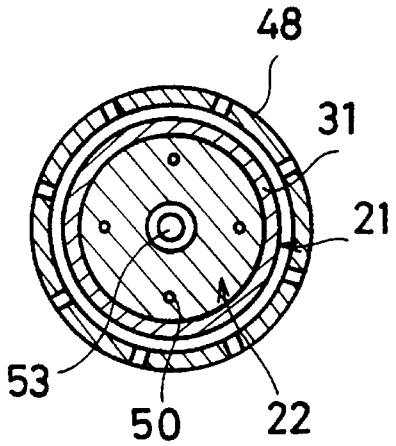
FIG. 3*b* is a cross-sectional view along IIIb—IIIb in FIG. 2.

The piston 22 is inserted into the cylinder from the upper open end of the cylinder 21 until its bottom surface is placed in a lower portion 31 of the cylinder 21 (i.e. the portion of the cylinder below the lower ends of the windows 41). Then, the piston 22 is fixed in position. More specifically, as shown in FIG. 3*a*, a support plate 43 is joined to the upper surface of the piston 22. The support plate 43 has four laterally extending projections 45, which extend outward through the corresponding windows 41 in the cylinder 21. The four projections 45 are secured, together with the protective cover 10, to a flange 46 formed in the bottom end of the pipe 8. The protective cover 10 is formed such that it can cover the periphery of the cylinder 21 in its bottom dead center, with a sufficient clearance left therebetween. The protective cover 10 is provided with a number of small holes 10*a* extending therethrough.

The piston 22 is a short column. The bottom surface of the piston 22 is provided with a recess 49. In the illustrated example, the recess 49 is a circular groove formed in the bottom surface of the piston 22 to surround the center of the bottom surface. The groove has a triangular cross-section as shown in FIG. 2.

The piston 22 is provided with a plurality of bubble discharge paths 50. In the illustrated example, four bubble discharge paths 50 are provided in the piston 22 at equal angular intervals of 90 degrees along the periphery of the piston 22. Each of the bubble discharge paths 50 has one bubble discharge port 50*a* at the bottom of the recess 49. Each of the bubble discharge paths 50 extends upward a predetermined length and then extends outward and has an opening 51 at the other end, which opens in the peripheral surface of the piston 22. The openings 51 of the respective paths 50 are at the same level from the bottom of the piston 22. The positions of the openings 51 along the periphery of the piston 22 are such that they face the corresponding ones of the windows 41 in the cylinder 21. The level of the openings 51 are such that when the cylinder 21 is at the bottom dead center, the respective openings 51 and, hence, the bubble discharge paths 50 are in communication with the associated windows 41 and, hence, with the exterior of the pump chamber 40. The respective openings 51 continue to be in communication with the windows 41 for a predetermined short time period after the cylinder 21 moves upward from its bottom dead center. After that, the opening 51 are closed by the lower portion 31 of the cylinder 21 so that the bubble discharge paths are closed off from the exterior. Thus, the lower portion 31 of the cylinder 21 functions as means for opening and closing the bubble discharge path openings 51.

A liquefied gas discharge port 52 formed at the center of the bottom surface of the piston 22, which is located at a level lower than the bubble discharge ports 50*a*. The liquefied gas discharge port 52 opens into the pump chamber 40 and has its upper end connected to the lower end of a liquefied gas transport path 62. A discharge control valve 53, which is a ball in the illustrated embodiment, is disposed at the lower end of the path 62. The discharge control valve 53 is pressed against the upper end of the liquefied gas discharge port 52 to normally close it by means of a spring 53*a*.

A liquefied gas transport pipe 54 is connected to the path 62 by means of a threaded bolt 64 which is screwed into the path 62 through the support plate 43. The pipe 54 transports the liquefied gas to a desired location.

The discharge control valve 53 opens the liquefied gas discharge port 52 when the cylinder 21 moves upward so that the pressure within the pump chamber 40 becomes larger than the force provided by the spring 53*a*.

The reciprocal drive arrangement 23 includes a conventional crank arrangement 55 which converts rotational motion of a shaft 60, which is rotated by rotating means (not shown), into reciprocal motion of a connecting rod 56 coupled to the crank arrangement 55. The connecting rod 56 extends downward through the pipe 8 and has its lower end coupled to the end plate 33 of the cylinder 21 by means of a universal joint 57. Like this, the cylinder 21 is coupled to the crank arrangement 55 at a remote location by means of the connecting rod 56.

The reciprocal drive arrangement 23 further includes actuating means, such as a down-drive spring 59 which is compressed between the upper end of the cylinder 21 and a spring rest 58 formed in the pipe 8. The crank arrangement 55 causes the cylinder 21 to reciprocate up and down as the shaft 60 is driven to rotate by the rotating means. The spring 59 stores energy as the cylinder 21 moves upward and compresses the spring 59, and release the stored energy when the cylinder 21 moves downward. The universal joint 57 is used to permit swinging motion of the connecting rod 56 when it is driven by the crank arrangement 55.

Now, the operation of the pump 2 is described with reference to FIGS. 4*a*–4*d*.

Figure 4A:
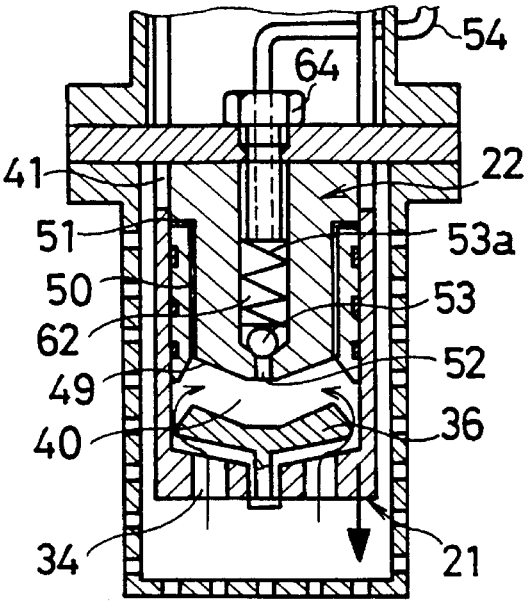
FIG. 4*a* is a cross-sectional view of the liquefied gas pump according to the first embodiment, showing a cylinder of the pump in the course of the downward moving.

As shown in FIG. 4*a*, when the cylinder 21 is moving downward so that the volume of the pump chamber 40 increases, the pressure in the chamber 40 is lower than the pressure outside the cylinder 21, which causes the entrance valve 36 to open. Then, liquefied gas is sucked from the tank 6 through the liquefied gas entrance port 34 into the pump chamber 40. That is, the suction stroke is achieved.

Figure 4B:
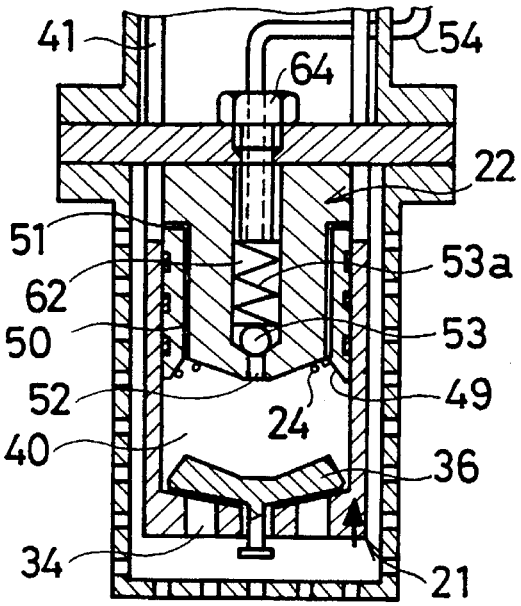
FIG. 4*b* is a cross-sectional view of the liquefied gas pump according to the first embodiment, showing the cylinder at the bottom dead center.
Figure 4C:
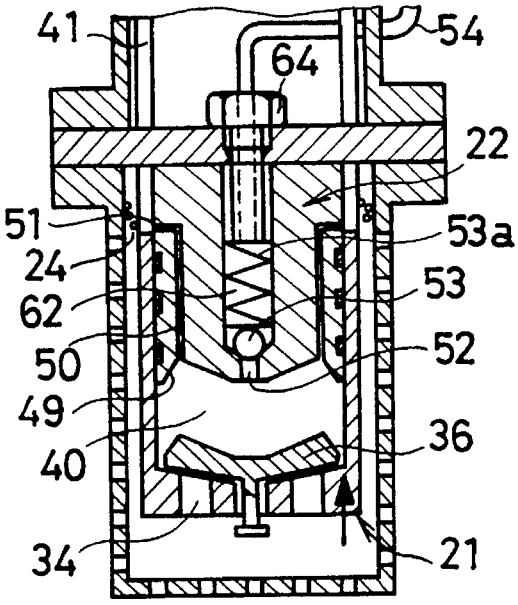
FIG. 4*c* is a cross-sectional view of the liquefied gas pump according to the first embodiment, showing the cylinder in the course of the upward moving.

After the cylinder 21 reaches the bottom dead center, as shown in FIG. 4*b*, the cylinder 21 starts to move upward so that the discharge stroke starts. If bubbles 24 have been generated due to cavitation during the suction stroke, they have gathered at the bottom (i.e. the highest point of the chamber 40) of the recess 49 due to their buoyancy. As the cylinder 21 starts moving upward, the entrance valve 36 is closed so that the pressure within the pump chamber 40 increases, which causes the bubbles 24 to enter into the bubble discharge paths 50 via the bubble discharge ports 50*a* and forced out through the openings 51 into the exterior of the pump chamber 40. At this time, a small amount of liquefied gas is also forced out with the bubbles 24.

Figure 4D:
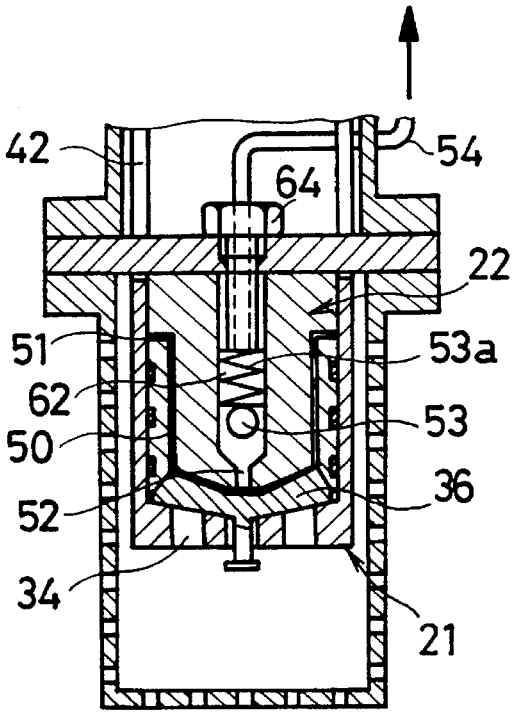
FIG. 4*d* is a cross-sectional view of the liquefied gas pump according to the first embodiment, showing the cylinder at the top dead center.
Figure 5A:
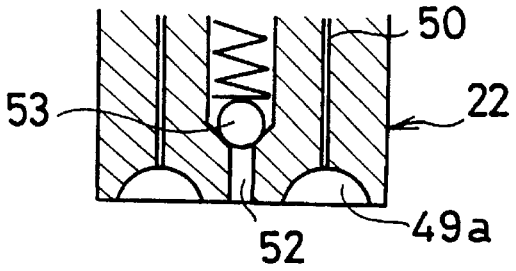
FIGS. 5*a* through 5*d* show various shapes of the lower surface of the fixed piston which can be employed in the liquefied pump of the first embodiment.
Figure 5B:
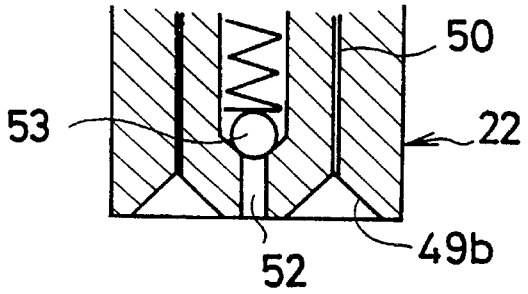
Figure 5C:
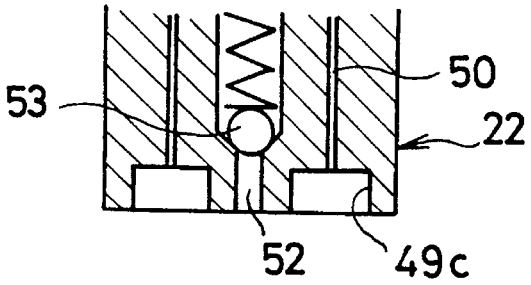
Figure 5D:
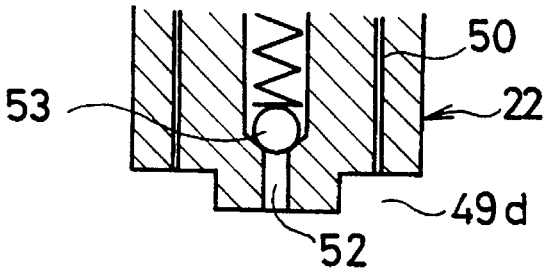

Around the time when the discharge control valve 53 opens as a result of the increase of the pressure in the pump chamber 40, the discharge of the bubbles 24 finishes and the lower portion 31 of the cylinder 21 closes the openings 51. The cylinder 21 continues to move upward so that the volume of the pump chamber 40 decreases, which causes the liquefied gas in the pump chamber 40 to be forced out through the liquefied gas discharge port 52, the liquefied gas transport path 62, and the liquefied gas transport pipe 54, until the cylinder 21 moves up to its top dead center, as shown in FIG. 4*d*.

The cylinder 21, then, starts moving downward, and the pressure within the pump chamber 40 starts decreasing, so that the liquefied gas discharge control valve 53 is closed and the entrance valve 36 is opened. Thus, the suction stroke starts. The cylinder 21 continues its downward movement through the position shown in FIG. 4*a*, so that the sucking of the liquefied gas continues. Then, the openings 51 are opened before the cylinder 21 reaches its bottom dead center. After the cylinder 21 reaches the bottom dead center, it starts its upward movement, and the same discharge and suction processes are repeated to feed liquefied gas from the fuel tank 6.

In the pump 2 of this embodiment, when the pressure within the pump chamber 40 starts rising as the discharge stroke begins, bubbles 24 are forced out of the pump chamber 40 through the bubble discharge ports 50*a* and through the paths 50, which avoids bubbles 24 from being broken within the pump chamber 40, which, in turn, avoids the pump from being damaged by vibrations and shocks otherwise generated by breaking of bubbles.

Around the time when the sucked liquefied gas starts being discharged, the bubble discharge paths 50 are closed by the lower portion 31 of the cylinder 21. Thus, the pumping efficiency of the pump 2 is reduced only little.

The bubble discharge ports 50*a* of the bubble discharge paths 50 are disposed in the bottom of the recess 49, i.e. at the top of the pump chamber 40, and, therefore, the flow of liquefied gas entering through the entrance port 34 does not interfere with the gathering of bubbles in this portion of the chamber. This permits all of bubbles 24 gathering in this portion to be discharged without fail during the following liquefied gas discharge stroke.

During the downward movement of the cylinder 21, the spring 59 (FIG. 3) presses the cylinder 21 downward, which minimizes the occurrence of the buckling of the connecting rod 56. By using the spring 59 which can provide a force substantially equal to or slightly less than the downward drive force necessary for the suction stroke, the axial compression force exerted to the connecting rod 56 becomes zero or substantially reduced. Thus, according to the invention, occurrence of the buckling of the connecting rod 56 which otherwise could occur due to lengthiness of the connecting rod 56 can be substantially reduced. Accordingly, the pump 2 can be fabricated slim and long so that it can be used with a deep fuel tank 6. In addition, because the connecting rod 56 can be thin, the pump 2 as a whole can be fabricated small.

The recess 49 in the bottom surface of the piston 22 of the pump 2 of the first embodiment has a triangular cross section. However, the shape of the recess 49 is not limited to the abovedescribed one. For example, as shown in FIGS. 5*a* through 5*d*, a recess 49*a* having a semi-circular cross-section, a recess 49*b* having an isosceles-triangular cross-section, or a recess 49*b* or 49*d* having a rectangular cross-section may be used. What is important is that the cross-sectional shape of the recess should be such as to facilitate gathering of bubbles 24 around the ports 50*a* of the bubble discharge paths 50 at the top of the pump chamber 40.

Figure 6:
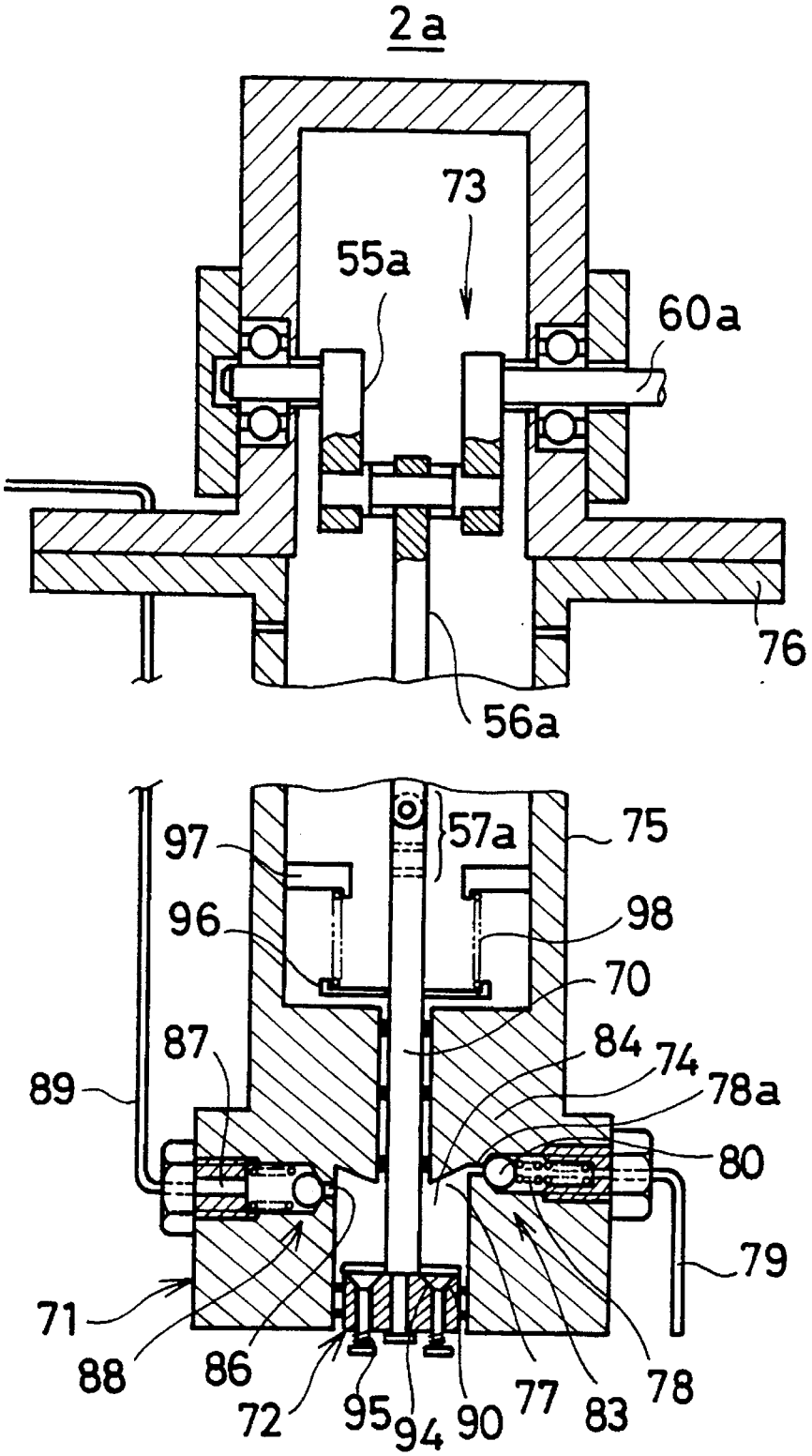
FIG. 6 is a longitudinal cross-sectional view of part of a liquefied gas pump according to a second embodiment of the present invention.

A liquefied gas pump 2*a* according to a second embodiment of the present invention is now described with reference to FIGS. 6 and 7. The pump 2*a* also may be used for transferring liquefied gas in a fuel tank to a vaporizer of an internal combustion engine, for example.

The pump 2*a*, too, includes a cylinder 71, a piston 72, and a reciprocal drive arrangement 73. Different from the pump of the first embodiment, in the pump 2*a* according to the second embodiment, the cylinder 71 is fixed, whereas the piston 72 inserted into the cylinder 71 is driven up and down.

The cylinder 71 has its bottom end open, through which the piston 72 is inserted to close it. The cylinder 71 has an upper end wall 74 fixed to the lower end of a cylinder supporting pipe 75 which extends upward. In the illustrated embodiment, the cylinder 71 and the pipe 75 are formed integral with each other. The pipe 75 has a flange 76 at its upper end which is secured to the opening of the fuel tank. The end wall 74 and the side wall of the cylinder 71 and the top surface of the piston 72 inserted therein define a pump chamber 84.

The end wall 74 of the cylinder 71 has a circular recess 77 having a triangular cross-section in its bottom or lower surface. A plurality, three, for example, of bubble discharge paths 78 having respective bubble discharge ports 78*a* which open into the recess 77 at equally spaced locations along a circumference of the cylinder side wall. The bubble discharge paths 78 extend through the side wall of the cylinder 71 radially outward, and have their outer ends connected to associated discharge pipes 79 disposed outside the pump. The discharge pipes 79 extend downward and have open ends.

Figure 7:
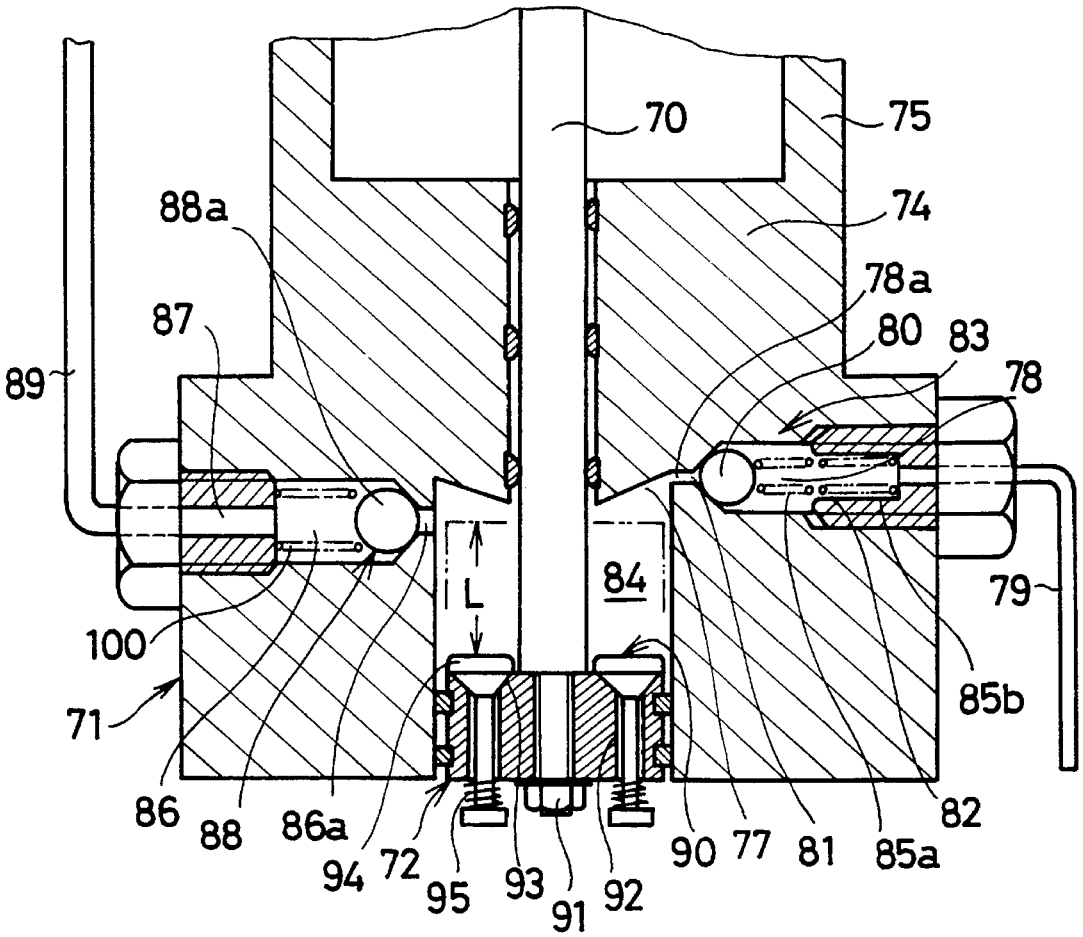
FIG. 7 is an enlarged view of part of the pump shown in FIG. 6.

As shown in FIG. 7 which shows an enlarged view of part of the pump 2*a*, a valve 83 is disposed in the middle of each of the bubble discharge paths 78. Each valve 83 has a valve port 81 on its cylinder side and a valve port 82 on its discharge pipe side. Each valve 83 includes a ball-shaped valve body 80 which opens and closes the valve ports 81 and 82. In each of the bubble discharge paths 78, two springs 85*a* and 85*b*, which provide different forces, are serially arranged. When the pressures on both sides of each ball-shaped valve body 80 are equal or when the pressure within the pump chamber 84 is lower than the pressure in the associated discharge pipe 79, the two springs 85*a* and 85*b* act on the ball-shaped valve body 80 to close the valve port 81. When the pressure within the pump chamber 84 increases a little, the ball-shaped valve body 80 moves against the spring force provided by, for example, the spring 85*a* to thereby open the valve port 81, and when the pressure within the pump chamber 84 further increases to approach the pump discharge pressure, the valve body 80 moves against the spring force of, for example, the spring 85*b* and closes the valve port 82.

A liquefied gas discharge path 86 has a liquefied gas discharge port 86*a* which opens into the pump chamber 84 at a location slightly lower in level than the bubble discharge ports 78*a*. The liquefied gas discharge path 86 extends radially through the side wall of the cylinder 71, and a liquefied gas discharge pipe 89 is connected to the outer end of the liquefied gas discharge path 86. A discharge valve 88 is provided in the discharge path 86, which includes a ball-shaped valve body 88*a* which normally closes the liquefied gas discharge port 86*a* by the action of a spring 100 disposed within the path 86. When the pressure within the pump chamber 84 increases to a liquefied gas discharge pressure, the ball-shaped valve body 88*a* opens the liquefied gas discharge port 86*a* against the spring 100.

The piston 72 is arranged in such a manner as to close the lower open end of the cylinder 71 to thereby form the pump chamber 84, as stated previously. The piston 72 is slidable up and down so that the volume of the pump chamber 84 changes. Seal rings are fitted around the peripheral surface of the piston 72. A piston rod 70 has a lower end portion which has a smaller diameter than its upper portion, and the smaller diameter lower portion is inserted into a bore formed to extend through the center of the piston 72. The bore has a diameter slightly larger than the diameter of the lower end portion of the piston rod 70 loosely held by a nut 91 so as to permit a small amount of radial movement of the rod 70. The upper portion of the piston rod 70 extends upward through the end wall 74 of the cylinder 71, and its upper end is connected to the reciprocal drive arrangement 73. Seal rings are also disposed around the peripheral surface of the piston rod 70. The loose fitting of the piston rod 70 with respect to the piston 72 can permit displacement of the axes of the piston rod 70 and the piston 72 relative to each other.

A plurality, four in the illustrated embodiment, of liquefied gas entrance paths 92 are formed to extend through the piston 72. The entrance paths 92 are disposed with an equal angular distance from each other around the periphery of the piston 72. A valve body 94 of an entrance valve 90 is disposed to close an entrance port 93 on the pump chamber side of each entrance path 92 by the action of a coil spring 95 acting on the valve body 94. When the pressure within the pump chamber 84 is lower than the external pressure, the valve body 94 is moved upward against the force provided by the coil spring 95 so as to open the entrance port 93.

The reciprocal drive arrangement 73, like the reciprocal drive arrangement 23 of the first embodiment, includes a crank arrangement 55*a*, a connecting rod 56*a*, and a universal joint 57*a* which is connected to the piston rod 70. The crank arrangement 55*a* converts rotational motion of a shaft 608, which is rotated by rotating means (not shown), into reciprocal motion of the connecting rod 56*a* coupled to the crank arrangement 55. A spring 98 is compressed between a spring seat 97 formed in the pipe 75 above the end wall 74 of the cylinder 71 and a spring seat 96 formed on the piston rod 70.

As in the first embodiment, the pump 28 of the second embodiment is attached by means-of the flange 76 at the top of the pipe 75 to the top wall of a fuel tank containing liquefied gas, as shown, for example, in FIG. 1. The cylinder 71 has such a length that its bottom end is located near the bottom of the fuel tank.

The rotation of the shaft 608 causes the piston 72 to move up and down to pump up liquefied gas from the fuel tank.

FIG. 7 shows a state of the pump 28 in which the piston 72 has reached its bottom dead center and liquefied gas has been sucked into the pump chamber 84. In this state, the entrance valves 90 close the respective entrance ports 93 of the entrance paths 92, the valve bodies 80 close the valve ports 81 and, hence, the bubble discharge ports 78*a* of the bubble discharge paths 78, and the valve body 88 closes the liquefied gas discharge port 86*a*.

As the piston 72 starts moving upward from this state, the pressure in the pump chamber 84 increases. In the beginning stage of the increasing of the pressure in the pump chamber 84, the bubble discharge ports 78*a* are opened so that bubbles which have gathered in the uppermost portion of the pump chamber 84 (i.e. the bottom of the recess 77) are forced out together with a small amount of liquefied gas through the bubble discharge paths 78 and the bubble discharge pipes 79.

When the pressure in the pump chamber 84 increases as the piston 72 moves further upward and reaches a value set by the spring 85*b* which is near the liquefied gas discharge pressure, the valve ports 82 are closed by the valve bodies 80. Thereafter, when the pressure within the pump chamber 84 reaches the liquefied gas discharge pressure, the valve body 88 opens the liquefied gas discharge port 86*a* so that the liquefied gas within the pump chamber 84 is forced out through the discharge path 86. That is, a discharge stroke is achieved.

When the piston 72 rises by a predetermined stroke L to the top dead center, the discharge of liquefied gas from the pump chamber 84 is stopped and, therefore, the valve body 88 closes the port 86*a*. Then, the piston 72 starts moving downward, which causes the pressure within the pump chamber 84 to decrease. Accordingly, at the beginning of the decreasing of the pressure within the pump chamber 84, the valve bodies 80 of the valves 83 close the valve ports 81 and, hence, the bubble discharge ports 78*a*.

As the piston 72 moves further down, the pressure within the pump chamber 84 becomes negative so that the entrance valves 90 open their associated entrance ports 93, which causes liquefied gas in the fuel tank to be sucked into the pump chamber 84. Thus, a suction stroke is achieved. During the suction stroke, cavitation may cause bubbles of the gas to be formed in the pump chamber 84. Such bubbles go upward through the liquefied gas and gather in the bottom of the recess 77 which is the highest point in the pump chamber 84.

When the piston 72 reaches the bottom dead center, the entrance valves 90 close the entrance ports 93, and, thereafter, the discharge stroke described above is repeated. During the initial portion of the discharge stroke, the bubbles are discharged.

The above-described alternating suction and discharge strokes are repeated to transfer liquefied gas from the fuel tank to a desired location.

With the arrangement of the pump 2*a* described above, bubbles are discharged through the bubble discharge paths 78 when the pressure within the pump chamber 84 begins increasing in the beginning of the discharge stroke, which prevents bubbles from being broken within the pump chamber 84. Accordingly, the pump 2*a* is prevented from being damaged by vibrations and shocks caused by breaking of bubbles. By the time when the discharge of liquefied gas starts, the bubble discharge paths 78 are closed, decrease of discharge efficiency is advantageously kept very small. Another advantage is that since the bubble discharge ports 78*a* are in the bottom of the recess 49, i.e. at the highest location in the pump chamber 84, liquefied gas flowing into the pump chamber 84 through the entrance ports 93 from the entrance paths 92, which are remote from the recess 49, does not interfere with bubbles gathering at the entrance ports of the bubble discharge paths 78. Accordingly, bubbles are forced out without fail through the bubble discharge paths 78 at the beginning of the next discharge stroke. Still another advantage of this structure is that because the spring 98 assists the connecting rod 56 in forcing down the piston 72, the connecting rod 56 hardly buckles. This means that by appropriately choosing the force given by the spring 98, the axial compression force to be given to the piston 72 by the connecting rod can be reduced. This enables the use of the connection rod 56 and, therefore, the pump 2*a* which are thin and long enough for use with a deep fuel tank. In addition, the use of a thin connecting rod makes it possible to reduce the size of the pump.

What is claimed is:

1. A liquefied gas pump including a pump chamber defined by walls of a piston and a cylinder, said pump chamber having a liquefied gas entrance path having a liquefied gas entrance port and a liquefied gas discharge path having a liquefied gas discharge port, said ports opening into said pump chamber, in which relative movement between said piston and said cylinder in the upward and downward directions provides a repetition of alternating suction and discharge strokes, liquefied gas being sucked into said pump chamber through said liquefied gas entrance path during said suction stroke, said liquefied gas being discharged out of said pump chamber through said liquefied gas discharge path during said discharge stroke; wherein:

said pump chamber further includes a separate bubble discharge path having a bubble discharge port opening into said pump chamber which enables said pump chamber to communicate with the exterior of said pump chamber during an initial stage of said discharge stroke;

a recess is formed in the top wall of said pump chamber in such a manner that the highest point of said recess is located at a level higher than the level of said liquefied gas discharge port, said bubble discharge port opening into said pump chamber at said highest point of said recess;

said top wall of said pump chamber is provided by an end wall of said piston;

said piston is fixed to the lower end of a pipe of which the upper end is adapted to be fixed;

said cylinder is fixed to the lower end of a rod extending through a longitudinal bore which extends through said pipe; and a reciprocating arrangement for reciprocating said cylinder in the upward and downward directions is coupled to the upper end of said rod.

2. The liquefied gas pump according to claim 1 wherein:

said bubble discharge path is formed in said piston;

said cylinder includes a window extending upward from a point in an intermediate portion thereof along the length of said cylinder; and said bubble discharge path causes said pump chamber to communicate with the exterior through said window during an initial period of upward movement of said cylinder from the bottom dead center thereof, and, thereafter, said bubble discharge path is closed by a portion of said cylinder below said window.

3. The liquefied gas pump according to claim 1 wherein:

said reciprocating arrangement comprises means for reciprocating said rod up and down, and downward driving force providing means for providing downward driving force to said cylinder when said cylinder moves downward.

* * * * *